US005623718A

United States Patent [19]

Bracken et al.

[11] Patent Number: 5,623,718

[45] Date of Patent: Apr. 22, 1997

[54] EXTENDED LIFE COMPLIANT DOCTOR BLADE WITH CONDUCTIVE ABRASIVE MEMBER

[75] Inventors: Peter W. Bracken; Jeffery R. Brener; Martin V. DiGirolamo; Donald W. Stafford; Peter E. Wallin, all of Lexington, Ky.

[73] Assignee: Lexmark International, Inc., Lexington, Ky.

[21] Appl. No.: 524,275

[22] Filed: Sep. 6, 1995

[51] Int. Cl.[6] ..... G03G 15/08

[52] U.S. Cl. ..... 399/284

[58] Field of Search ..... 355/245, 246; 118/653, 656; 399/284

[56] References Cited

U.S. PATENT DOCUMENTS 5,085,171 2/1992 Aulick et al. ..... 118/653

5,170,213 12/1992 Yamaguchi et al. ..... 355/246

5,428,428 6/1995 Haneda ..... 355/246

*Primary Examiner*—William J. Royer

*Attorney, Agent, or Firm*—John A. Brady

[57] ABSTRACT

Doctor blade 1 has a compliant lamination (4) having a resin film backing layer (4*a*) and conductive layer (4*b*) abrasive silicon carbide particles and conductive carbon black in a resin binder. The compliant lamination is supported on an aluminum bar 2, having a downwardly extending wall 2*b*. In use lamination 2 is bent under the support bar at the end of the wall, a direct turn which avoids a wedge configuration where the lamination contacts the developer roller (7). The conductive layer remains conductive as it wears during use and the avoidance of the wedge prevents a build-up of toner at the nip during use, both of which make possible long effective useful operation of this doctor blade.

17 Claims, 1 Drawing Sheet

EXTENDED LIFE COMPLIANT DOCTOR BLADE WITH CONDUCTIVE ABRASIVE MEMBER

TECHNICAL FIELD

This invention relates to electrophotographic development and, more particularly, relates to a compliant doctor blade operative on a developer roller.

BACKGROUND OF THE INVENTION

U.S. Pat. No. 5,085,171 to Aulick et al, assigned to the same assignee to which this application is assigned, is directed to a compliant doctor blade having a thin metal outer layer on a grit surface which faces the developer roller. This replaces prior rigid doctor blades which therefore could permit the toner layer of the developer roller to vary with surface variations in the doctor blade itself and the developer roller it comes in contact with. Such variations in the toner layer result in corresponding variations in the visible image made by the toner, both print and graphics. A compliant doctor blade ideally eliminates such variations.

That compliant doctor blade, although successfully used, has an effective life limited by the wearing away of the outer metal layer, as the metal is a necessary electrical path to charge the doctor blade where it contacts the developer roller.

The purpose of the doctor blade where it contacts a sector of the developer roller is three fold: 1) to help charge the toner, 2) to uniformly meter the correct amount of toner onto the developer roller prior to development, and 3) to repel toner of the opposite potential (termed wrong sign toner) so that it does not pass the doctor blade and become simply wasted toner. The surface roughness of the doctor blade is important to improve interaction with both the developer roller and the toner on the developer roller. The electric continuity to the contact sector on the developer roller, not exceeding a certain resistance, is important to permit the electrical functions of the doctor blade.

In addition to the wearing away of the metal layer of the compliant doctor blade of the foregoing patent, use of such a configuration in longer life applications permits an accumulation of toner at the entry area to the nip of the doctor blade with the developer roller due to compression on the corner of the foam which is in the shape of a wedge. When this wedge forms, it interferes with the ability of the doctor blade to meter the correct amount of toner, resulting in print quality problems on specific gray scale patterns (patterns of small images or dots separated but closely spaced to give the visual appearance of gray). Furthermore, once this wedge of toner appears, toner tends to begin fusing into the nip area of the doctor blade and the developer roller. This further alters the metering capabilities, resulting in rapid and severe degradation in print quality.

DISCLOSURE OF THE INVENTION

In accordance with this invention long lasting electrical continuity is achieved by making the lapping film itself conductive. Conductive carbon black is added to the formulation of standard filming binder and abrasive particles. Specifically, a liquid mixture of polyurethane based adhesive, abrasive particles and conductive carbon black is applied and cured to a solid on a thin supporting substrate of plastic.

In a second change from the previous doctor blade, the supporting body extends downward to be a front barrier to almost all of the area in back of the nip with the developer roller, thereby minimizing the wedge shape formed by the bent-back film of the previous doctor blade.

The long life flexible doctor blade of this invention exhibits two unique advantages 1) consistent electrical continuity to the nip through the life of the toner cartridge, and 2) geometry which eliminates the potential for a wedge of toner to form at the nip.

BRIEF DESCRIPTION OF THE DRAWING

The details of this invention will be described in connection with the accompanying drawing, in which.

BEST MODE FOR CARRYING OUT THE INVENTION

Figure 1:
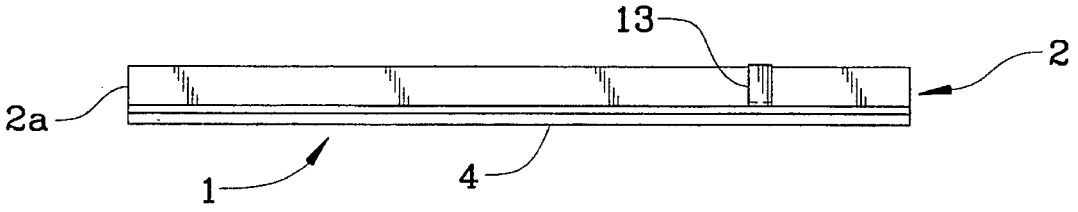
FIG. 1 is a view from the rear of the doctor blade.
Figure 2:
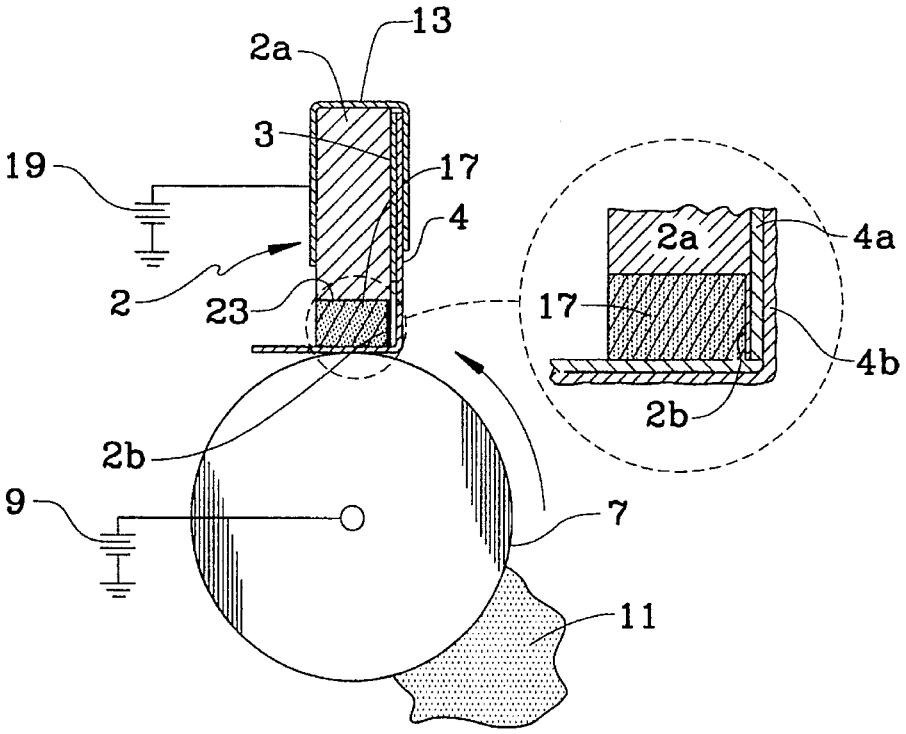
FIG. 2 is an enlarged side view of the doctor blade and the developer roller in operation.

As shown in FIG. 1 this compliant doctor blade 1 comprises a support bar 2 of aluminum, specifically supporting body 2*a*, which is 3.8 mm by 10 mm aluminum 1100 stock bar 231.5 mm in length and a further extending wall 2*b*(FIG. 2), discussed below. Extending throughout the length of bar 2 is a laminate 4 having an 0.002 to 0.005 inch thick substrate 4*a* (FIG. 2) of compliant polyethylene terephthalate polyester resin film carrying a solid, cured layer 4*b* having a thickness of 18 to 28 micrometers, of cured polyurethane having thoroughly dispersed throughout grit particles of silicon carbide in the range of 13 to 16 micrometer diameter and conductive carbon black. In FIG. 2 the thicknesses of elements 4*a* and 4*b* are exaggerated.

Laminate 4 is held to bar 2 by a commercial dual side adhesive tape 3 of 1 mil thick polyester having adhesive on both sides, with total thickness of 0.13 mm, width of 8.5 mm, and length coextensive with the length of bar 2.

Developer roller 7 comprises a semiconductive, organic elastomer charged to a predetermined potential by a fixed potential source 9. Roller 7 is contacted with a supply of charged toner 11 in the lower-right area of FIG. 2 as developer roller 7 rotates counterclockwise. The toner is normally primarily charged to a polarity the same as the polarity of roller 7 while having a significant amount of toner charged to the opposite polarity. The sector of developer roller 7 encountering doctor blade 1 carries such toner, and the toner of opposite polarity is blocked by the charged doctor blade 1 so that only a thin layer of toner 11 passes doctor blade 1 and that thin layer is charged in great predominance to the correct polarity.

A narrow (preferably 8 mm wide) conductive band 13 spans bar 2. Band 13 is preferably an 18 mm long section of commercially available copper grounding tape, which has a conductive adhesive side which is attached to the laminate 4 across the top of bar 2 and an opposite conductive adhesive side which is attached to bar 2 opposite laminate 4. Band 13 provides an electrical contact between the laminate 4 and bar 2. Laminate 4 is charged through band 13 in the same polarity as roller 7 by a fixed potential source 19 which contacts the back of band 18. An alternative to band 18 is to simply punch a hole in laminate 4 at the location where electrical contact is to be made and fill that hole with a conductive adhesive, such as an epoxy adhesive, which is then cured to a solid.

In use laminate 4 is compliant and is simply bent back at a position contiguous to developer roller 7. As shown in FIG. 2, a continuous body of foam 17 is located under support bar 2 between support bar 2 and laminate 4, in the area past the surface of bar 2 at which laminate 4 is attached. Bar 2 has a depending portion or wall 2*b*, 0.5 mm thick, which extends from the body 2*a* of bar 2. Wall 2*b* extends along the operative width of doctor blade 1 as does the body 2*a*. (An alternative to form wall 2*b* where a simple bar 2*a* is available, is to replace adhesive tape 3 with a 10 mil thick polystyrene tape with adhesive, on both sides which is wide enough to extend past bar 2*a* to form wall 2*b* by the part extending past bar 2*a*.)

Doctor blade 1 differs from the prior compliant doctor blade by wall 2*b*, which ends in a position to force laminate 4 to turn substantially directly toward the nip areas at the base of wall 2*a*, resulting in reduction in the size of the wedge areas between doctor blade 1 and developer roller 7 where toner can accumulate. As with the previous compliant doctor blade, foam 17 behind the laminate 4 opposite the nip area of doctor blade 1 and developer roller 7 provides the desirable flexibility and compliance to the developer roller 7.

To further reduce the wedge forming geometry, the optimum thickness of the resin substrate 4*a* is 0.002 inch. Thicker film of that material is too rigid to form a sharp corner at the base of the wall 2*b*. Thinner film of that material yields no additional benefit in wedge reduction and is more difficult to work with.

Preferably foam 17 is a commercially available polyurethane foam of density of 20 lbs. per cubic foot. Foam 17 is held in place by a double side adhesive tape 23 4 mm in width and 0.13 mm thick. Various alternatives to foam 17 may be readily employed, and foam 17 may be eliminated by using naturally straight steel or copper as thin as about 0.00254 cm as the support layer 4*a*. When bent back as described, the inherent resilience of the metal provides the force toward roller 7.

Laminate 4 is made by curing a slurry of a thorough mixture of silicon carbide grit, conductive carbon black and polyurethane based adhesive applied as a thin coating to the resin substrate 4*a*, which may be 0.002 to 0.005 inch thick. This slurry is cured to form the conductive layer 4*b*. The carbon black provides conductivity.

Type XE-2 carbon black, a product of Degussa, is preferred. A peak response in electrical properties is obtained at a loading 5% by volume in the slurry, which results in electrical resistance less than 1×10E5 (ten to the fifth power) ohms/square. Loading higher than 5% by volume results in a surface roughness which is too smooth for the correct metering of toner, regardless of the size of the abrasive particle.

There is a peak response in the doctoring performance using abrasive particles in the 13 to 16 micrometer diameter range. This grit size yields an average roughness of 0.9 to 1.1 micrometer Ra. Particle sizes smaller than 13 micrometer in diameter result in a surface that is too smooth, allowing excessive toner to be metered under doctor blade 1. Particle sizes larger than 16 micrometer in diameter result in a surface that is too rough, allowing too little toner under doctor blade 1. Also, larger particle sizes create peaks on the surface which scrape too much toner from the surface of developer roller 7 in a narrow area, resulting in vertical streaks in the printed page. Any type of ceramic oxide grit is believed satisfactory, such as SiC, Al2O3, and TiO2 within the foregoing particle size range.

By being conductive throughout, as lamination 4*b* wears away, the electrical properties remain consistent. Wall 2*b* minimizes wedge formation of toner. Accordingly this cartridge can function very well for a very large number of imaging operations.

Variations in the form and in the materials used are readily visualized and would be within the contemplation of this invention. Coverage is sought as provided by law, with particular reference to the accompanying claims.

We claim:

1. An electrically energized doctor blade for metering charged electrophotographic toner held on a developer roller by physically contacting a sector of said roller with a surface of said blade which is electrically charged, said blade comprising a compliant backing member, a supporting member to position said blade adjacent to said roller, and a layer on said complaint backing member comprising a solid binder having dispersed throughout said binder grit particles and a conductive filler, said compliant backing member and said layer with grit and conductive filler being attached to said supporting member and being bendable to extend under said supporting member to contact said layer with grit and conductive filler with said sector of said developer roller during use.

2. The doctor blade as in claim 1 in which said grit is of particle size in the range of 13 to 16 micrometers in diameter.

3. The doctor blade as in claim 2 in which said grit is a ceramic oxide.

4. The doctor blade as in claim 3 in which said supporting member includes an extension from a body of said supporting member ending at a position at which said complaint backing member and said layer with grit and conductive filler when bent toward said sector turns substantially directly toward said sector.

5. The doctor blade as in claim 2 in which said supporting member includes an extension from a body of said supporting member ending at a position at which said compliant backing member and said layer with grit and conductive filler when bent toward said sector turns substantially directly toward said sector.

6. The doctor blade as in claim 1 in which said conductive filler is carbon black in amount to provide an electrical resistance less than 1×10E5 ohms/square.

7. The doctor blade as in claim 6 in which said grit is of particle size in the range of 13 to 16 micrometers in diameter.

8. The doctor blade as in claim 7 in which said grit is a ceramic oxide.

9. The doctor blade as in claim 5 in which said supporting member includes an extension from a body, of said supporting member ending at a position at which said complaint backing member and said layer with grit and conductive filler when bent toward said sector turns substantially directly toward said sector.

10. The doctor blade as in claim 7 in which said supporting member includes an extension from a body of said supporting member ending at a position at which said compliant backing member and said layer with grit and conductive filler when bent toward said sector turns substantially directly toward said sector.

11. The doctor blade as in claim 6 in which said grit is a ceramic oxide.

12. The doctor blade as in claim 11 in which said supporting member includes an extension from a body of said supporting member ending at a position at which said compliant backing member and said layer with grit and conductive filler when bent toward said sector turns substantially directly toward said sector.

13. The doctor blade as in claim 6 in which said supporting member includes an extension from a body of said supporting member ending at a position at which said compliant backing member and said layer with grit and conductive filler when bent toward said sector turns substantially directly toward said sector.

14. The doctor blade as in claim 1 in which said grit is a ceramic oxide.

15. The doctor blade as in claim 6 in which said supporting member includes an extension from a body of said supporting member ending at a position at which said complaint backing member and said layer with grit and conductive filler when bent toward said sector turns substantially directly toward said sector.

16. The doctor blade as in claim 1 in which said supporting member includes an extension from a body of said supporting member ending at a position at which said compliant backing member and said layer with grit and conductive filler when bent toward said sector turns substantially directly toward said sector.

17. An electrically energized doctor blade for metering charged electrophotographic toner held on a developer roller by physically contacting a sector of said roller with a surface of said blade which is electrically charged, said blade comprising a compliant, electrically conductive abrasive member and a supporting member to position said blade adjacent to said roller, said complaint abrasive member being attached to said supporting member and being bendable to extend under said supporting member to contact said conductive abrasive member with said sector of said developer during use, said supporting member including an extension from a body of said supporting member ending at a position at which said compliant abrasive member when bent toward said sector turns substantially directly toward said sector.

* * * * *